United States Patent [19]

Thompson et al.

[11] 3,930,927

[45] Jan. 6, 1976

[54] TAPE DISPENSER FOR DOUBLE-COATED TAPE

[75] Inventors: Dorman N. Thompson, Oakdale, Minn.; Aldon W. Haglund, Hudson, Wis.

[73] Assignee: Minnesota Mining and Manufacturing Company, St. Paul, Minn.

[22] Filed: May 20, 1974

[21] Appl. No.: 471,328

[52] U.S. Cl. ..... 156/530; 156/577

[51] Int. Cl.[2] ..... B32B 31/18; B32B 35/00

[58] Field of Search ..... 156/530, 506, 510, 521, 156/518, 520, 577

[56] References Cited

UNITED STATES PATENTS

| | | | |
|---|---|---|---|
| 2,468,619 | 4/1949 | Franke | 156/530 |
| 3,117,051 | 1/1964 | Kornblum | 156/304 |
| 3,764,439 | 10/1973 | Rome | 156/442 |
| R25,056 | 10/1961 | Fritzinger | 156/523 |
| R28,010 | 5/1974 | Way | 156/530 |

*Primary Examiner*—Douglas J. Drummond
*Assistant Examiner*—M. G. Wityshyn
*Attorney, Agent, or Firm*—Alexander, Sell, Steldt & DeLaHunt

[57] ABSTRACT

An apparatus is disclosed for dispensing discrete lengths of a double-coated adhesive tape onto a substrate. The device has a housing with one open side. An applicating drum with a plurality of flat applicating surfaces disposed about its circumference is rotatably mounted inside the housing near one end. A roll of double-coated adhesive tape is supported in the housing, the tape being pulled off the supply roll as the drum rotates. A base is attached to the housing extending along the open side of said housing and has an opening through which an applicating surface can pass. Means rotate the applicating drum upon movement of the housing toward and away from the base to bring an applicating surface bearing double-coated tape into an applicating position where the cutting means sever a short length of the double-coated tape and transfers the tape to a substrate.

5 Claims, 4 Drawing Figures

TAPE DISPENSER FOR DOUBLE-COATED TAPE

FIELD OF THE INVENTION

This invention applied to tape applicating devices and in particular, to devices for applying short lengths of a double-coated tape to a substrate.

PRIOR ART

U.S. Pat. 3,455,769 issued July 15, 1969 to D. G. Way discloses a device where a feed member having a plurality of axially arranged faces is supported within a housing. A continuous length of tape having adhesive on one side is directed onto the feed member with the adhesive disposed away from the faces of the feed member. The tape is held on the feed member by a holding device in such a manner that no adhesive will contact the feed member nor any other surface to which it could adhere. As the device is activated, a corner on the feed member formed by the intersection of adjacent faces passes across a round hard roller and the pressure between the roller and the corner severs the tape.

U.S. Pat. 2,468,619 issued Apr. 26, 1949 to K. J. Franke, discloses a device for applying short lengths of adhesive tape to a substrate. The tape is carried from a supply roll to an applicating position by means of two endless belts, one belt being disposed at each edge of the tape. At the applicating position, a knife partially severs that portion of the tape between the belts and a plunger, narrower than the gap between the belts, presses the tape from the belts onto the substrate.

The prior art devices involve complex feeding and cutting mechanisms which are large to maintain the proper tolerances between the parts, cumbersome, and expensive. In addition, the complex mechanisms require a substantial amount of pressure to operate.

The applicator of this invention overcomes the problems of prior art devices. The applicator is a simple, light-weight, inexpensive and easy to operate device for applying short tabs of double-coated adhesive tape to a substrate. Because of its easy operation, the applicator of this invention is suitable for use in attaching papers to a file. One example of such an application is for placing short tabs of tape on an insurance rider which can then be permanently, adhesively attached to the back of a general policy. The operational movements are common to that of a hand operated stamp, printer or stapler.

BRIEF SUMMARY OF THE INVENTION

The applicator comprises an apparatus for dispensing short, discrete lengths or tabs of a double-coated adhesive tape onto a substrate. The device has a housing with one open side, the housing containing an applicating drum rotatably mounted in and near one end of the housing. The applicating drum has a plurality of flat applicating surfaces disposed about the circumference thereof. Means is provided for supporting a supply of double-coated tape within said housing. Tape from the supply will contact the drum at a tape receiving position and rotate with the drum throughout a portion of its rotation until reaching a tape applicating position where the tape is severed.

A base having an opening through which an applicating surface can pass is attached to and supports the housing. The base extends along the open side of the housing. Means attached to the housing and the base bias them away from each other.

Means rotate the applicating drum incrementally when the housing is moved toward and away from the base, the rotation bringing an applicating surface bearing double-coated tape into position opposite the opening in the base.

Registering means position the applicating surface with respect to the opening in the base and cutting means sever the double-coated tape to form a tape tab. As the apparatus is activated, the severed length of tape is exposed to the opening in said base and is transferred to a substrate through said opening.

DETAILED DESCRIPTION OF PREFERRED EMBODIMENTS

Figure 1:
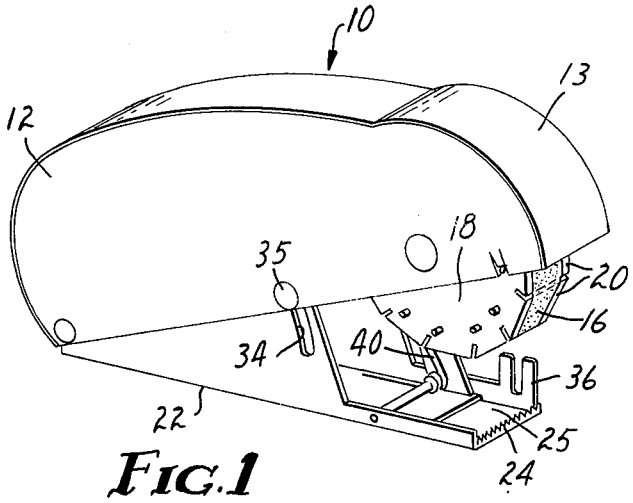
FIG. 1 is a perspective view of one embodiment of this invention.
Figure 2:
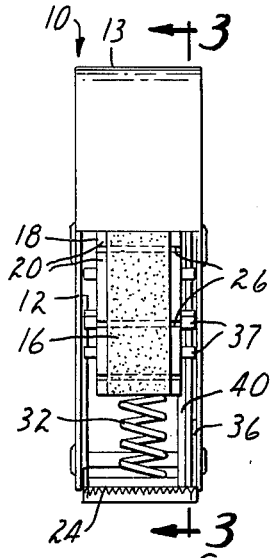
FIG. 2 is a front elevation of the embodiment shown in FIG. 1.
Figure 3:
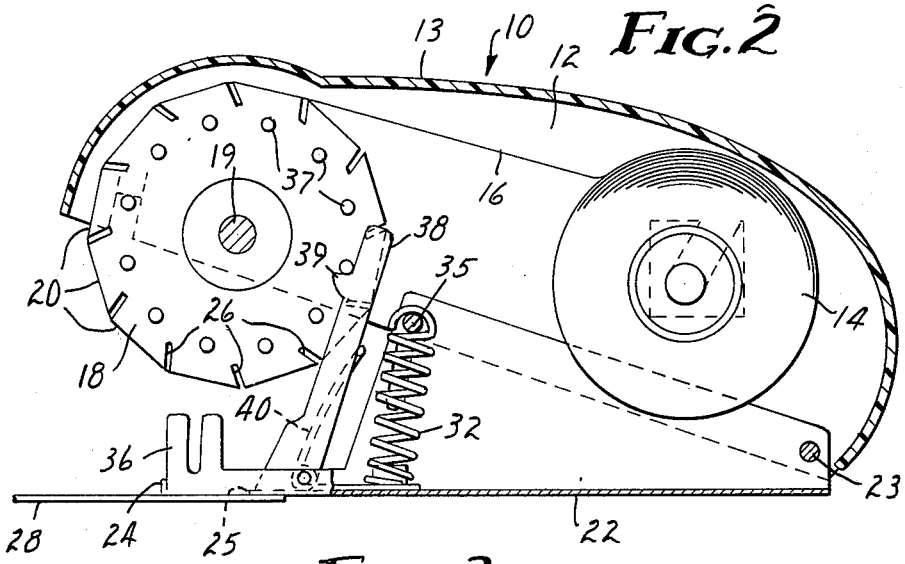
FIG. 3 is a sectional view taken along the lines 3—3 of FIG. 2.
Figure 4:
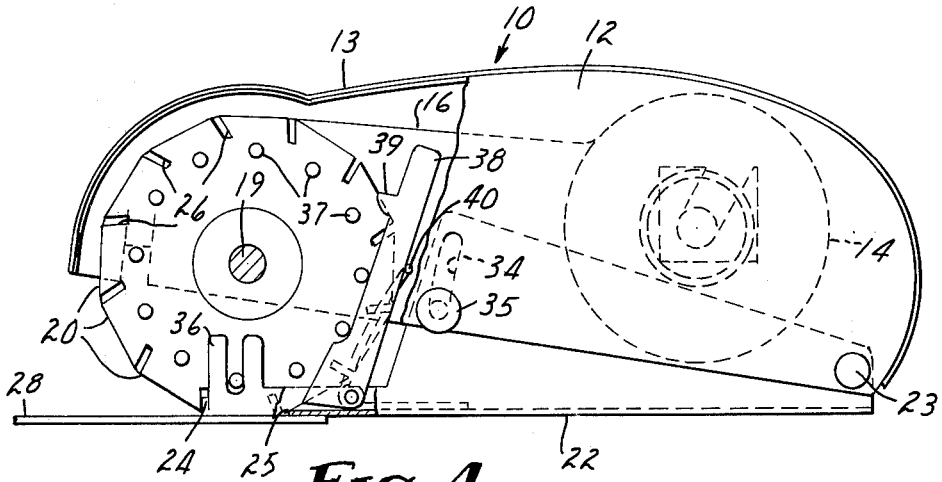
FIG. 4 is a view similar to FIG. 3 with the device in a closed applicating position, the operating mechanism being shown in elevation.

Generally, an applicator 10 of this invention has an elongated housing 12 with a supply roll 14 of double-coated tape 16 mounted on a support positioned near one end of the housing. The tape 16 is pulled or fed onto an applicating drum 18 having a plurality of adjacent flat applicating surfaces 20 disposed about the circumference of the drum.

As a base member 22, pivotally attached to an open side of the housing 12, is moved toward or away from the housing, the applicating drum 18 will be rotated to bring one of the applicating surfaces 20 bearing a fresh piece of double-coated tape 16 into a tape applicating position aligned with an opening 25 in the base 22. A blade 24 will cut a piece of tape 16 as the blade passes through the tape into one of a number of slots 26 in the drum 18. The severed length of tape will contact a substrate 28, the adhesive on the tape adhering to the substrate more tenaciously than to the applicating surface 20. As the spring 32 moves the housing 12 away from the base 22, the double-coated tape will remain on the substrate.

In greater detail, the applicating drum 18 is rotatably mounted on a shaft 19 at one end of the housing 12. The applicating drum has a plurality of applicating surfaces 20 disposed about its circumference. The surfaces 20 are disposed on chords of the drum 18 and provide a flat surface suitable for exerting an even pressure on the tape to be applied. To reduce adhesion to the applicating surfaces 20, they can be knurled or serrated so the tape 16 will contact the surface over only a fraction of its area.

The roll 14 of double-coated adhesive tape 16 is rotatably mounted on a support in the housing 12 spaced apart from the applicating drum 18. The tape 16 contacts the drum 18 at the tape receiving position remote from the tape applying position where it is aligned with the opening 26 in the base. The tape is thus in contact with the drum throughout a substantial portion of its periphery. As shown, the tape is in contact with the drum for 180 degrees or more. The adhesive tape 16 adheres to the applicating drum 18 with sufficient force so that as the drum is rotated, it will tension the tape sufficiently to unwind it from the roll 14 even though the tape has been convolutely wound without a release liner between adjacent convolutions.

One end of the base 22 is hinged to the housing 12 by shaft 23 at the end of the housing opposite the applicating drum 18. Near the center of the applicator 10 a curved cam slot 34 is engaged by a cam follower 35 mounted on the housing 12. The housing 12 and base 22 are biased into an open position by a spring 32.

As shown, the base 22 has a pawl 38 which projects from the base into the housing 12. The pawl 38 is biased in the direction of the applicating drum 18 as by spring 40 and a detent 39 adapted to engage the pins 37. As the base 22 and the housing 12 are brought together, the detent 39 engages one of the pins 37 rotating the drum 18 an amount sufficient to bring one of the applicating surfaces 20 loaded with tape into line with the opening 25 in the base.

A registering means is formed by a bifurcated member 36 which projects from the base towards the housing. The member 36 is positioned to engage one of the number of pins 37 disposed on the applicating drum 18. As the base and the housing are brought closer together, the member 36 engaging a pin positions the applicating surface 20 with respect to the opening 25 and the cutting blade 24 with respect to one of the slots 26. The applicating surface continues down severing the tape and placing the severed length of tape onto the substrate 28. After a tab of tape has been disposed on the substrate, pressure on the housing is released and the spring 32, which has been compressed, will bias the housing 12 and base 22 to an open, spaced position.

In addition to the means for rotating the applicating wheel shown herein other combinations are possible, for example, it is possible to arrange a system whereby the applicating drum 18 is rotated as the applicator returns to the open position. Also, various other structures wherein a housing is biased to an open position away from the base are possible.

The dispenser shown has a removable top 13 formed from a piece of plastic material. When a roll of double-coated tape has been completely used, the top is removed, a new roll of tape inserted into the roller, the tape placed in contact with the applicating drum and the top replaced. The dispenser is then ready for continued application.

Various modifications and alterations of the invention will be obvious to those skilled in the art, and it is to be understood that this invention is not to be limited to the illustrative embodiment described hereinbefore.

What is claimed is:

1. An apparatus for dispensing discrete lengths of double-coated adhesive tape onto a substrate comprising:

a housing having one open side;

an applicating drum rotatably mounted in and near one end of said housing, said drum having a plurality of flat applicating surfaces disposed about the circumference thereof;

means for supporting a supply of double-coated adhesive tape in said housing near the opposite end of said housing, said applicating drum and said tape being positioned whereby tape from said supply roll contacts said drum at a tape receiving position remote from a tape applying position where said tape is applied to said substrate, said supply being adapted to feed a continuous length of tape to said applicating drum;

a base pivotally attached to the housing adjacent said opposite end and extending along the open side of said housing, the base having an end with an opening adjacent said one end of said housing through which a single applicating surface can pass;

means attached to said housing and said base to bias said one end of said housing away from said base;

means for rotating said applicating wheel upon movement of said one end of said housing toward and away from said base to bring an applicating surface bearing double-coated tape into an applicating position;

registering means to position said applicating surface in registry with the opening in said base; and cutting means for severing the double-coated tape on said applicating surface from the supply of tape;

whereby as the apparatus is activated, a severed length of tape is exposed in said opening and transferred to said substrate.

2. The apparatus of claim 1 where said means for rotating said applicating wheel comprises:

a plurality of pins disposed on and axially projecting from the sides of said drum; and a pawl mounted on said base extending into said housing and having a detent adapted for engaging said pins so that when said end of said base and said one end of said housing are moved toward and away from each other said detent will engage one of said pins thereby rotating said applicating drum.

3. A device of claim 1 where said cutting means comprises a plurality of evenly spaced slots extending into said drum and a cutting blade mounted on said base and positioned opposite said drum so that as said base is moved toward said housing, said blade will enter one of said slots severing said tape thereacross.

4. A device of claim 1 where said applicating surfaces are knurled thereby lessening the adhesion of said double-coated tape to said applicating surface.

5. An apparatus for dispensing discrete lengths of double-coated adhesive tape onto a substrate comprising:

a housing having one open side;

an applicating drum rotatably mounted in and near one end of said housing, said drum having a plurality of flat applicating surfaces disposed about the circumference thereof and a plurality of slots extending across the width of said drum evenly spaced about the circumference of said drum;

a base pivotally mounted to said housing adjacent the end thereof opposite said one end, said base having an opening in an end thereof opposite said pivotal mounting through which an applicating surface can pass;

means for supporting a supply of convolutely wound double-coated adhesive tape adjacent said opposite end of said housing, said means being adapted to feed a continuous length of tape to said applicating roller, said tape making contact with said applicating drum at a point remote from the point at which said applicating surface will apply said tape to a substrate;

a plurality of pins disposed on and projecting axially from the sides of said applicating roller;

a pawl mounted on said base extending into said housing and having detent means for successively engaging said pins;

a cutting blade mounted on said base, said blade being positioned at the end of said base opposite said pivotal mounting to engage said slots to sever said double-coated tape into discrete lengths; and means positioned between said housing and said base for biasing said one end of said housing away from said base into an open position;

whereby when said base and said housing are pivoted relative to each other, said pawl engages one of said pins rotating said applicating drum until one of said flat applicating surfaces having tape disposed thereon is in line with said opening in said base, and said cutting blade will sever said tape allowing said tape to be applied to a substrate by said applicating surface.

* * * * *